United States Patent [19]

Heller

[11] Patent Number: 4,833,456

[45] Date of Patent: May 23, 1989

[54] SKI SECURITY DEVICE

[75] Inventor: Elmer J. Heller, Huntington Beach, Calif.

[73] Assignee: Summit Sports, Inc., Huntington Beach, Calif.

[21] Appl. No.: 162,615

[22] Filed: Mar. 1, 1988

[51] Int. Cl.[4] ..... G03B 13/14

[52] U.S. Cl. ..... 340/571; 340/526; 340/687; 340/689

[58] Field of Search ..... 340/568, 571, 689, 636, 340/309.15, 687, 526, 527, 529, 521, 825.31; 200/61.47, 61.52; 280/809

[56] References Cited

U.S. PATENT DOCUMENTS

| | | | |
|---|---|---|---|
| 3,500,376 | 3/1970 | Cooper | 340/689 X |
| 3,755,778 | 8/1973 | Kennedy et al. | 340/571 X |
| 3,988,724 | 10/1976 | Anderson | 340/689 X |
| 4,023,157 | 5/1977 | Miller | 340/571 |
| 4,057,791 | 11/1977 | Bimmerlie et al. | 340/571 |
| 4,190,828 | 2/1980 | Wolf | 340/571 |
| 4,365,240 | 12/1982 | Scarpino, III et al. | 340/571 |
| 4,385,288 | 5/1983 | Bitko | 340/571 |
| 4,535,322 | 8/1985 | Yeski | 340/571 |
| 4,573,043 | 2/1986 | Heuker of Hoek et al. | 340/571 |

*Primary Examiner*—Glen R. Swann, III
*Assistant Examiner*—Thomas J. Mullen, Jr.
*Attorney, Agent, or Firm*—Stetina and Brunda

[57] ABSTRACT

An anti-theft alarm device for portable articles is disclosed. The device comprises a motion sensing component for sensing movement of the device and for generating an alarm actuating signal in response to such movement. A conductive tether is attached to the device and extends around the article, holding the article in a predetermined position in relation to the device, and for generating an alarm activating signal upon disconnection of the cable to permit movement of the article from a predetermined position. A microprocessor is provided to receive alarm activating signals from the motion sensing component and the conductive tether, and to receive input signals entered by digital code entering means connected to the microprocessor.

9 Claims, 3 Drawing Sheets

SKI SECURITY DEVICE

BACKGROUND OF THE INVENTION

The present invention relates generally to a means for preventing theft of various items of personal property, and more particularly to a device for preventing theft of unattended snow skis and the like.

The invention is particularly useful in connection with snow skis and will, therefore, be described with particular reference thereto. However, it must be appreciated that the invention has a broad range of applicability and may, indeed, be useful in preventing or deterring the unauthorized movement of various other items including golf clubs, luggage, purses, briefcases, video equipment, etc.

It is common practice for skiers to leave their skis unattended from time to time as they enter buildings, lodges, and the like. Indeed, it is not unusual for ski lodges and other buildings frequented by skiers to have many pairs of skis left outside the entrances thereto. Thus, such areas create an inviting location for willing vandals or thieves to damage or wrongfully appropriate ski equipment belonging to others. Accordingly, it remains desirable to provide new and improved theft alarms to prevent or deter such activity.

Examples of ski theft alarms of the prior art are disclosed in U.S. Pat. Nos. 4,023,157 (Miller) and 4,535,322 (Yeski). Miller discloses an electronic theft alarm for portable articles, including skis, which may be attached to a particular article by way of a set of pivoting jaws. Once the jaws of the Miller device have been locked about the article, the device is activated to trigger a motion sensing electronic circuit therein. Such circuit will then trigger an audible alarm in response to any detected unauthorized movement of the article. Yeski discloses a theft alarm and runaway ski locator comprising a housing attached or mounted on top of one ski surface and having an audible signaling device and power source positioned within such housing. A remote switch with lockable jaws is connected via a cable to the device such that the cable may be wrapped around a pole or other stationary object prior to clipping of the jaws in a desired position. When the jaws are removed from their placed position, or when the cable is cut, an audible alarm will sound. By such arrangement, the Yeski device is purportedly usable as a ski alarm as well as a lost ski locator to help the skier find runaway skis. The anti-theft capability of the Yeski device generally requires extension of the cable and locking jaws around a pole or other stationary object, thereby locking the skis to such object.

Additionally, various types of motion sensitive alarms have been described elsewhere. Examples of such motion sensitive alarms are found in, U.S. Pat. Nos. 4,190,828 (Wolf), 4,365,240 (Scarpino III et al.), and 4,057,791 (Bimmerle).

Although such prior art devices have proven effective in each of the limited applications, there remains a substantial need in the art for a truly portable, multidirectionally motion sensitive anti-theft device for use with snow skis and other items of personal property. Accordingly, the present invention is directed to one such device as described herein.

BRIEF DESCRIPTION OF THE INVENTION

The present invention contemplates a novel motion sensing alarm device for securing unattended skis and other easily movable items of personal property.

In accordance with the invention there is provided a security device or "burglar alarm" adapted for attachment to a pair of skis or other items of personal property. Such security device is further adapted to emit an alarm signal when such property is subjected to a predetermined level of unauthorized movement in any direction.

In accordance with a further aspect of the invention, the device may include a micro-controller component having a simple computer containing a logic control unit, a small amount of read-write memory, and a fixed ROM that contains a desired program.

In accordance with an even further aspect of the invention the device is alternately switchable between an "armed" mode or a "sleeping" mode in accordance with input commands received from the operator and/or the sensing of certain conditions by the device. One manner in which the device may be "armed" is through the movement of an external switch applying immediate ground to previously unpowered subcircuits within the device. Such subcircuits will then signal the micro-controller of the device to initiate an operational program as well as a variety of attendant or accessory functions, such as battery checking, etc. The device will thereafter follow such operational program to (a) monitor a motion sensing component within the device and (b) monitor a ski retention tether cable attached to the exterior of the device. If the motion sensing component senses a predetermined level of unauthorized movement of the skis or if any effort is made to disconnect or cut the tether cable, the device will respond by emitting an audible alarm.

In accordance with a still further aspect of the invention the device may be powered by one or more batteries Such battery powered embodiment of the invention may be further provided with a low battery detector circuit which will periodically check the battery circuit and, if the battery voltage is incorrect or current too low, will cause the unit to "beep" in short tones intended as an operator feedback signal. After emission of such operator feedback signal, the battery detector circuit will subsequently cause the device to go into its "sleeping" state until the batteries have been changed or the problem corrected.

In accordance with an even further aspect of the invention the unit may be adapted to emit periodic short beeping sounds (i.e., every 15 seconds) during use. Such beeping sounds emanating from the armed device are intended to render its presence obvious to potential thieves or vandals, thereby serving as a psycological deterrent to theft as well as a true "burglar alarm" should the perpetuator prove unresponsive to such psychological deterrent.

In accordance with yet another aspect of the invention the device will be specifically programmed to require more than a single sudden movement before sounding its audible alarm. Thus, if one's skis were to be accidentally knocked over while the inventive device is armed and functioning, no alarm would sound unless some subsequent or continued movement were to occur. However, repetitive or continual movement of the skis would result in the sounding of an alarm to warn the rightful possessor of possible theft or tampering.

In accordance with a still further aspect of the invention the device is provided with a conductive tether cable adapted for extension around the skis. Additionally, the device may be programmed to signal the operator in the event that it is "armed", but the tether cable remains detached. Thus, after the operator has entered a keyboard code arming the device, along with any required "sensitivity" or "alarm duration" orders, the unit will go into its "armed" mode. Thereafter, the device will emit a predetermined pattern of short beeps until such time as the tether cable is properly connected. If the tether cable is so connected, the unit will then become fully armed and functional. However, if the tether remains unattached and the operator fails to heed the "unattached tether warning beeps", the unit will subsequently go into its sleeping mode until such time as it is rearmed. The tether will generally comprise an electrically conductive cable having connectors positioned at either end thereof so as to be insertible into opposite ports provided on the exterior unit. Thus, such tether may be plugged into one port, extended around the pair of skis, and plugged into the opposite port, thereby completing a circuit between the first port and the second port of the device.

A principal object of the device is to provide a portable, multi-directionally motion sensitive anti-theft device for use with snow skis and other personal property subject to unauthorized movement.

An additional object of the invention is to provide a motion sensitive security warning device for use with skis and other personal property which will refrain from emitting an alarm signal when such property is merely subjected to a single movement as may occur accidentally, but which will certainly sound an appropriate alarm signal if subsequent or continued movement occurs.

Yet another object of the invention is to provide an anti-theft security device of the foregoing character which is sufficiently portable to be attached to a pair of snow skis in a permanent or semi-permanent manner while not interfering with routine use of the skis.

A still further object of the invention is to provide an anti-theft security device of the foregoing character which is relatively simple to operate and which may be manufactured in a reproducible and economically feasible manner.

DESCRIPTION OF THE PREFERRED EMBODIMENT

Figure 1:
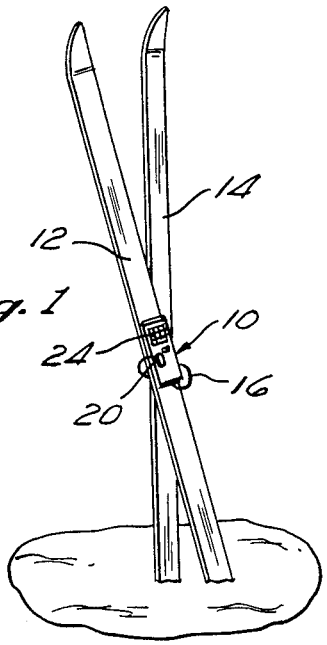
FIG. 1 is a perspective view of a preferred ski security device of the present invention operatively connected to a pair of snow skis.

As shown in FIG. 1, a preferred embodiment of the present invention includes an alarm device 10 mounted as by way of an adhesive strip on the upper surface of a ski 12. In a normal unattended position, the ski 12 bearing the device 10 is positioned next to its paired ski 14. The tether cable 16 extends around both skis 12 and 14 so as to firmly attach the device 10 to the ski pair 12 and 14 and to complete an electrical circuit within the device.

Figure 2:
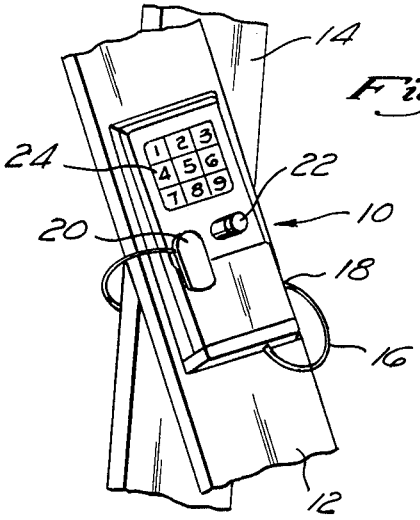
FIG. 2, is an expanded perspective view of a preferred device of the present invention operatively connected to a pair of snow skis.

The various aspects of the device may be more fully appreciated from the expanded view of FIG. 2. In FIG. 2, the device 10 is again shown in its operative position mounted on the upper surface of ski 12. The tether cable 16 is shown to extend from an output port 18 of the device around the pair of skis and is attached at its opposite end by way of a connector 20 to an input port located on the front of the device 10. With the tether cable 16 connected in the manner shown in FIG. 2, an external key 22 may be moved to its triggering position by the operator. Thereafter, the device 10 will continually monitor the consistency of the circuit completed by cable 16 and, if any effort is made to remove or disconnect the cable, an alarm will sound.

Also, an internal motion sensing component of the device will be continually monitored by the armed device. A keyboard 24 is positioned on the face of the device 10 enables the operator to input various commands and codes. Specifically, the operator may input a release or "unlock" code through the keyboard which will function to de-arm the device prior to authorized movement of the skis or detachment of the tether cable 16.

Figure 3:
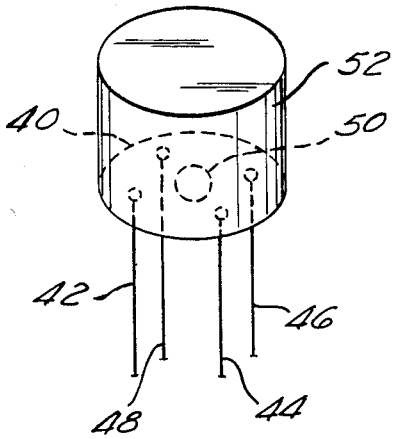
FIG. 3 is a diagram of a preferred motion sensing component of the present invention.

The motion sensing alarm function of the device is achieved through the use of a motion sensor component, such as that shown in FIG. 3. The motion sensor component of the device comprises generally an insulated substrate 40 having multiple conductors 42, 44, 46, and 48 positioned thereon. A mercury ball 50 is freely positioned within the area defined by the conductors 42, 44, 46, and 48 and a conductive cover 52 is positioned over the entire insulated substrate enclosing the conductors 42, 44, 46, and 48 and the mercury ball 50. The cover 52 is, itself, connected to ground potential. The multiple conductors 42, 44, 46, and 48 are, likewise, connected to one or more input ports of a micro-controller positioned within the device. Accordingly, if the motion sensor component is tilted or accelerated in any direction, the mercury ball 50 will come into contact with one or more of the conductors 42, 44, 46, or 48, or the conductive cover 52, thereby grounding one or more of the connected micro-controller ports. Such completed circuit will thus signal the micro-controller that an unauthorized movement has occurred. The preferred motion sensor component shown in FIG. 3 is presently commercially available as a component part through Signal Systems, P.O. Box 198, Holmdel, N.J.

Figure 4:
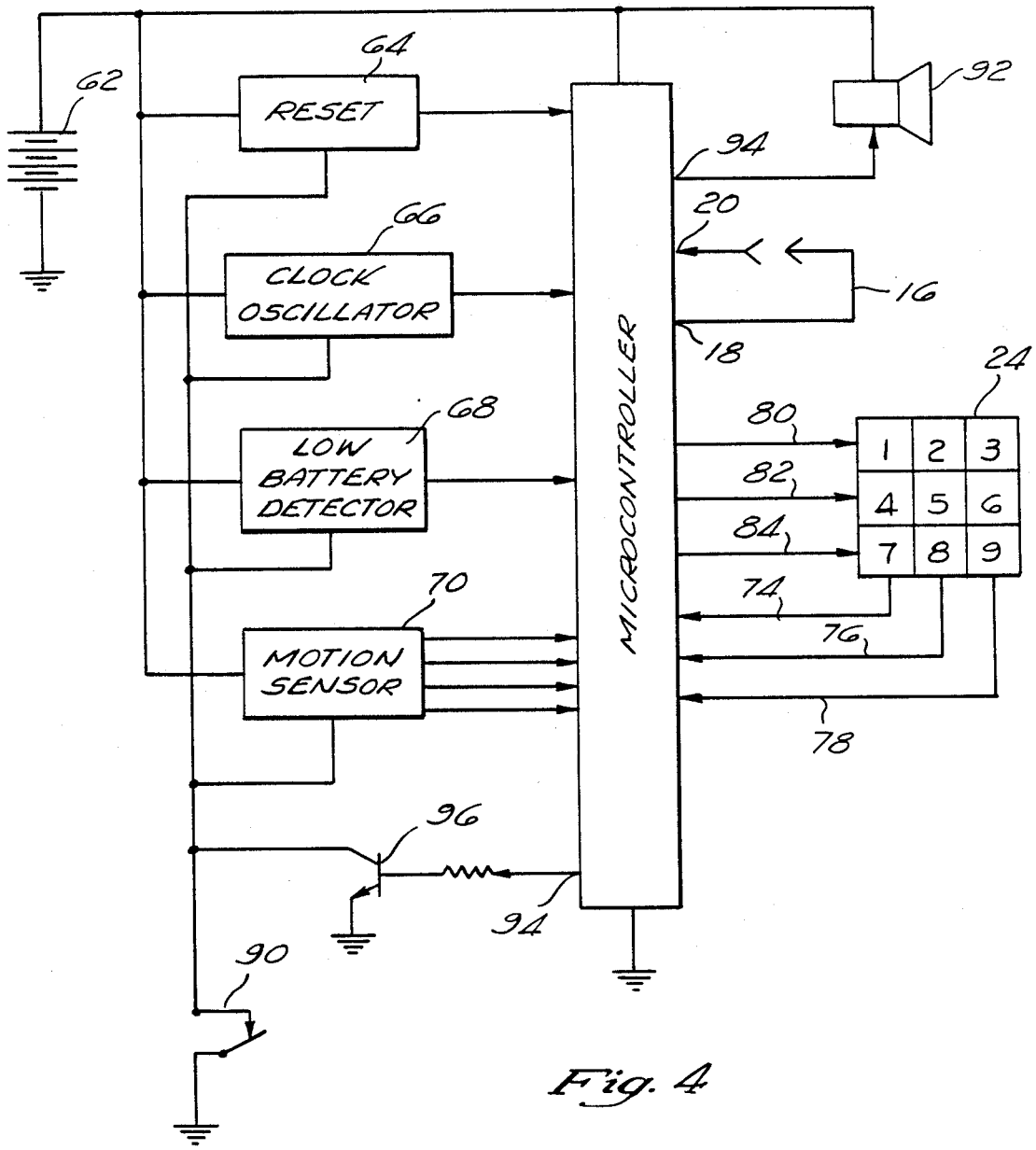
FIG. 4 is a schematic diagram of the electrical components and circuitry of a presently preferred embodiment of the invention.

FIG. 4 shows a schematic wiring diagram of the present invention. The micro-controller component 60 is operatively connected to the various subcircuits and external components of the device as shown. A battery 62 is operatively connected to the micro-controller as well as to several subcircuits 64, 66, 68, and 70 which provide input to the micro-controller. The reset circuit 64, clock oscillator 66, and low battery detector 68 subcircuits are conventional circuits well known in the art. The motion sensing subcircuit 70 includes the motion sensor component shown in FIG. 3 and described above.

As shown in FIG. 4, the multiple conductors of the motion sensor are connected to input ports of the micro-controller. Thus, any movement induced grounding of any of the conductors within the motion sensor component will cause a resultant grounding of one or more of the micro-controller ports to which the motion sensor conductors are attached.

The keyboard 72 is connected to separate micro-controller input ports 74, 76, and 78 as well as output ports 80, 82, and 84. The tether circuit 86 extends between output port 88 and input port 90. The tether circuit 86 extends within the tether cable described above in connection with FIGS. 1 and 2. An alarm 92 receives its output signal from an output port 94 of the micro-controller and is independently connected to battery 62. A separate output port 94 of the micro-controller is connected to transistor 96 which, in turn, is operatively connected to a line running between the "arm" key 98 and the various reset 64, clock oscillator 66, low battery 68, and motion sensor 70 subcircuits.

When the operator wishes to activate the device, he presses the "arm" key 90. Depression of the "arm" key 90 causes a ground to be applied to the previously unpowered subcircuits, including the reset 64, clock oscillator 66, low battery detector 68, and motion sensor 70 subcircuits. Accordingly, upon arming of the device, the reset subcircuit 64 will function to reset the micro-controller 60 and to thereby begin its operative program.

OPERATION OF THE PREFERRED EMBODIMENT

Figure 5:
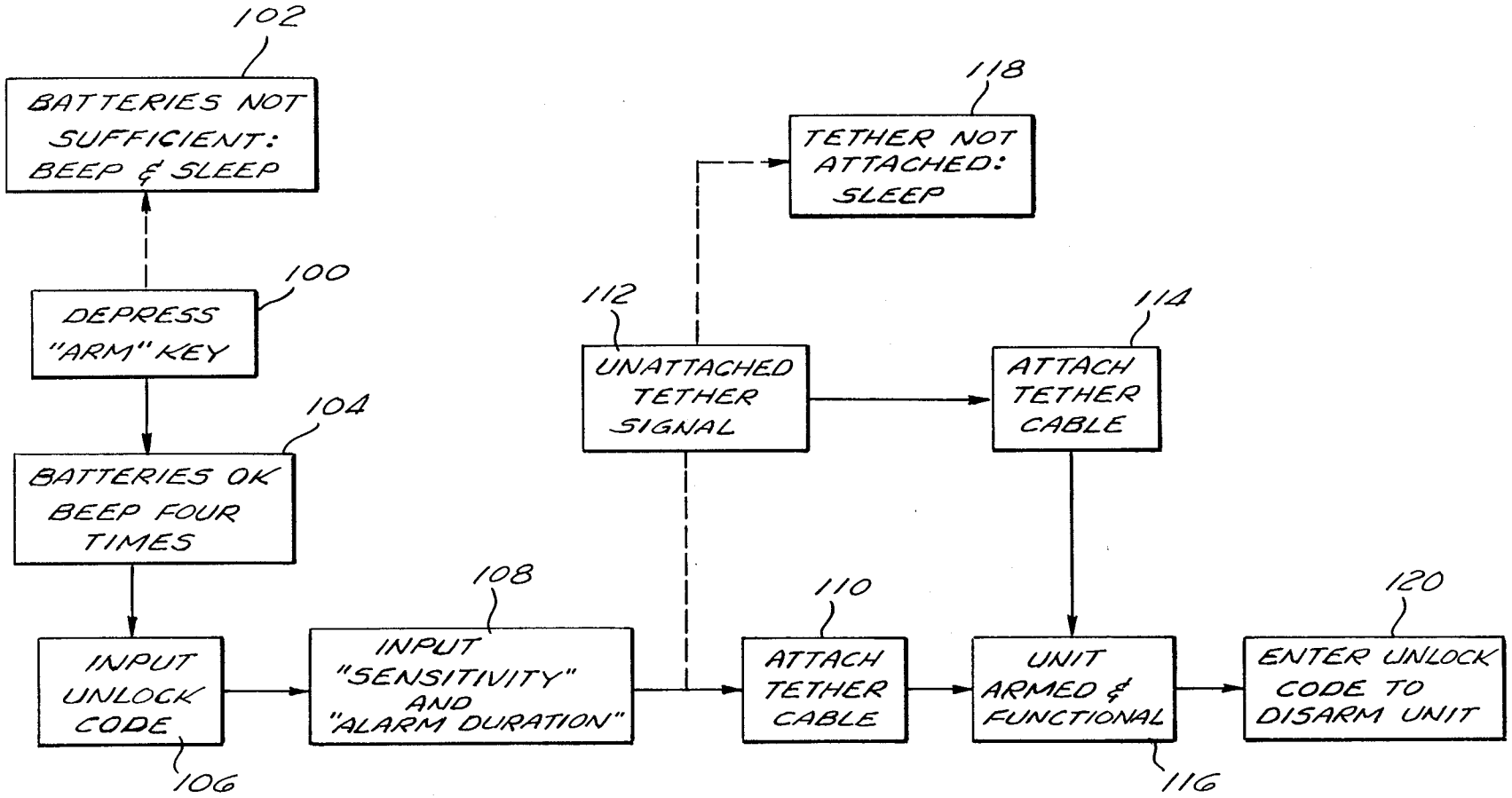
FIG. 5 is a flow diagram summarizing the presently preferred operative methodology of the present invention.

The operation of the preferred embodiment is carried out in accordance with the block diagram of FIG. 5.

When the batteries are first put into the unit or when the "arm" key is depressed 100, the unit will check the voltage and or current received from the battery. If the voltage and or current is too low, the microprocessor will cause the unit to "beep" eight (8) times and the unit will then power down into its sleeping state 102. If, on the other hand, the batteries are satisfactory, the unit will emit four (4) short beeps 104 to signal the operator that the unit is prepared to receive his "unlock" code. Such "unlock" code will consist of a predetermined number or series of digits which the microprocessor has been programmed to accept as a valid "unlock" code. Accordingly, the operator will enter his "unlock" code 106 via the keyboard of the device. If the "unlock" code which has been entered matches one of the previously programmed valid codes stored in the micro-controller, the device will then be readied to receive one or two additional numerical codes for the purpose of setting the "sensitivity" and "alarm duration" of the device 108. Generally, the "sensitivity" and "alarm duration" codes will be single digit codes from 1 to 9. The sensitivity numerical code determines the amount of time that may transpire between the first motion detected by the device and any second or continual motion sufficient to trigger its alarm. In a simple program the sensitivity code entered will be multiplied by two (2) to arrive at the number of seconds the unit will continue to monitor the motion sensing component between first motion and second motion sufficient to trigger the alarm. Thus, if a sensitivity code of two (2) is entered, the actual lag time will be five (5) times two (2) seconds equal ten (10) seconds. In such example, if the unit detects an initial motion, it will continue to monitor the motion sensor for a period of ten (10) seconds. If it detects a second motion within that ten-second interval, the alarm will be triggered. If the ten-second interval passes with no second motion being sensed, the device will return to its general "armed" mode.

The "alarm" duration numerical code is generally multiplied by thirty (30) seconds to arrive at the amount of time the alarm will sound after it has been triggered by unauthorized motion or disconnection of the tether. After such time has elapsed, the unit will go back to its general "armed" mode. Thus, if an alarm duration numerical code of two (2) is entered by the keyboard, the alarm will sound for a period of two (2) times thirty (30) seconds equals sixty (60) seconds before terminating. Of course, the input of a "sensitivity" code and "alarm duration" code are optional. If the operator chooses not to input specific code numbers, the device will resort to a preset "default" setting, such as five (5) for sensitivity and two (2) for alarm duration.

After the "unlock" code and the "sensitivity" and "alarm duration" codes have been entered, the operator will then attach the tether cable 110 to the device, thereby completing the tether cable circuit. If the tether cable remains unattached, the unit will emit an "unattached tether signal" 112. Such warning signal will consist of two short beeps per second until the tether is attached or for a period of fifteen seconds. If the tether is properly attached 114 during such period, or if it had been previously attached 110 prior to emission of any "unattached tether signal" 112, the unit will become fully armed and functional 116. If, however, the 15-second unattached tether signal period 112 is allowed to expire without attachment of the tether cable, the unit will go to sleep 118.

Presuming that the tether cable is attached in time and the unit becomes armed and functional 116, it may emit a short beep every 10 seconds to let those around it know that the unit is armed. However, it may not always be desirable for such continual beeping to occur. Therefore, the device is programmed to permit the operator to elect a personal "unlock" code which will either trigger or not trigger such continual beeping of the device while armed. Specifically, the device will be adapted such that entry of a personal "unlock" code ending in an even number will cause the device to beep every 10 seconds while armed. Entry of a personal "unlock" code ending in an odd number will not cause the device to beep while armed. Thus, the operator may elect whether such continual beeping function is desired.

When the operator wishes to disarm the unit, he may simply enter his personal "unlock" code 120 via the keyboard of the device. As each key is depressed, the unit will beep once to announce acceptance of the key. After depression of the first key, the operator is permitted 15 seconds before an alarm will sound to enter the proper code. If he enters the proper code the unit will beep four times and go to sleep. Thereafter, the tether may be disconnected and the skis may be moved around at will.

Although the invention has been described in conjunction with a preferred embodiment, it is to be understood that modifications and variations may be resorted to without departing from the spirit and scope of the invention, as will be readily understood by those skilled in the art. Such modifications and variations are considered to be within the perview and scope of the invention and the claims appended hereto.

What is claimed is:

1. An anti-theft alarm device for portable articles, said device comprising:

a motion sensing component for sensing movement of said device and for generating an alarm actuating signal in response to said movement;

a conductive tether attached to said device and extending around said article(s) for holding said article(s) in a predetermined position in relation to said device and for generating an alarm actuating signal upon disconnection of said tether as would permit movement of said article(s) from said position;

a microprocessor adapted to receive said alarm actuating signal from said motion sensing component and said conductive tether and to receive input signals entered by a digital code entering means connected to said microprocessor whereby input signals may be entered into said microprocessor; and a microprocessor component adapted to receive input from an operator of said device and to receive input from said motion sensing component and said conductive tether, whereby said microprocessor will emit an alarm generating signal upon receiving a predetermined output from said motion sensing component as well as upon receiving a signal resulting from unauthorized disconnection of said tether cable and wherein said microprocessor is specifically adapted to emit an alarm generating signal only after receiving two or more consecutive signals from said motion sensing component over a predetermined period of time.

2. The device of claim 1 wherein said microprocessor is adapted to receive an "unlock" code prior to becoming fully armed.

3. The device of claim 2 wherein said device is adapted to receive entry of said unlock code through said digital code entering means.

4. An anti-theft alarm device for portable articles, said device comprising:

a motion sensing component for sensing movement of said device and for generating an alarm actuating signal in response to said movement;

a conductive tether attached to said device and extending around said article(s) for holding said article(s) in a predetermined position in relation to said device and for generating an alarm actuating signal upon disconnection of said tether as would permit movement of said article(s) from said position;

a microprocessor adapted to receive said alarm actuating signal from said motion sensing component and said conductive tether and to receive input signals entered by a digital code entering means connected to said microprocessor whereby input signals may be entered into said microprocessor; and a microprocessor component adapted to receive input from an operator of said device and to receive input from said motion sensing component and said conductive tether, whereby said microprocessor will emit an alarm generating signal upon receiving a predetermined output from said motion sensing component as well as upon receiving a signal resulting from unauthorized disconnection of said tether cable and wherein said microprocessor is further adapted to receive a specific sensitivity input from the operator whereby the microprocessor will be adapted to wait a given amount of time between sensing a first motion and detecting a second motion sufficient to activate the alarm generating signal.

5. The device of claim 4 wherein said microprocessor is further adapted to return to a general armed mode if a second motion is not sensed within said time period.

6. The device of claim 5 wherein said microprocessor is further adapted to receive an "alarm duration" input from the operator whereby the duration of said alarm generating signal will be specifically controlled.

7. The device of claim 6 wherein said microprocessor is further adapted to trigger said alarm to emit periodic beeps while said device is armed and functioning.

8. The device of claim 7 wherein the programming of said microprocessor to emit said periodic beeps is achieved by entry of a specifically discernible unlock code via said digital code entering means.

9. The device of claim 8 wherein said microprocessor is adapted such that entry of an unlock code ending in an even number will cause said alarm to beep every ten seconds while said device is armed and functioning.

* * * * *